US011174124B2

(12) United States Patent
Schuler

(10) Patent No.: US 11,174,124 B2
(45) Date of Patent: Nov. 16, 2021

(54) ELEVATOR CAR

(71) Applicant: Inventio AG, Hergiswil (CH)

(72) Inventor: Christoph Schuler, Steinhausen (CH)

(73) Assignee: INVENTIO AG, Hergiswil NW (CH)

( * ) Notice: Subject to any disclaimer, the term of this patent is extended or adjusted under 35 U.S.C. 154(b) by 169 days.

(21) Appl. No.: 16/340,408

(22) PCT Filed: Nov. 9, 2017

(86) PCT No.: PCT/EP2017/078772
§ 371 (c)(1),
(2) Date: Apr. 9, 2019

(87) PCT Pub. No.: WO2018/091350
PCT Pub. Date: May 24, 2018

(65) Prior Publication Data

US 2019/0256323 A1 Aug. 22, 2019

(30) Foreign Application Priority Data

Nov. 15, 2016 (EP) ..... 16198987

(51) Int. Cl.
*B66B 5/00* (2006.01)
*B66B 11/02* (2006.01)

(52) U.S. Cl.
CPC ..... *B66B 5/0081* (2013.01); *B66B 5/0062* (2013.01); *B66B 11/0226* (2013.01)

(58) Field of Classification Search
CPC .. B66B 5/0081; B66B 5/0062; B66B 11/0226
See application file for complete search history.

(56) References Cited

U.S. PATENT DOCUMENTS 6,543,584 B1 * 4/2003 Miyakoshi ..... B66B 5/0081 182/113
6,830,127 B2 * 12/2004 Johnson ..... E02D 29/12 182/113

(Continued)

FOREIGN PATENT DOCUMENTS

CN 1436147 A 8/2003
CN 104354853 A 2/2015

(Continued)

OTHER PUBLICATIONS

JP2015196572—Machine translation (Year: 2015).*

*Primary Examiner* — Michael A Riegelman
(74) *Attorney, Agent, or Firm* — William J. Clemens; Shumaker, Loop & Kendrick, LLP

(57) ABSTRACT

An elevator car has a pivotable balustrade mounted on a roof of the elevator car and which can be pivoted between a folded-down position and an erected position. To secure the erected position, the balustrade has a locking mechanism by which the balustrade can be locked via a latching connection during a pivoting movement to produce the erected position. The balustrade includes a two-part post with a lower post part and an upper post part, the upper post part being pivotably fastened to the lower post part and on which the locking mechanism is arranged. A latching element of the locking mechanism is mounted vertically on the lower post part so as to be displaceable to a limited degree. The locking mechanism further has an actuating element in the form of a foot pedal or a lever for unlocking the locking position.

18 Claims, 5 Drawing Sheets

(56) References Cited

U.S. PATENT DOCUMENTS

| | | | | |
|---|---|---|---|---|
| 8,365,870 | B2 * | 2/2013 | Sirigu | B66B 13/22 187/306 |
| 10,233,054 | B2 * | 3/2019 | Ishiguro | E05F 1/12 |
| 10,836,605 | B2 * | 11/2020 | Roussel | B66B 5/0081 |
| 2005/0230194 | A1 * | 10/2005 | Nakamura | B66B 5/0081 187/401 |
| 2008/0217113 | A1 * | 9/2008 | Bonatre | B66B 5/0081 187/401 |
| 2008/0245619 | A1 * | 10/2008 | Monzon-Simon | B66B 5/0062 187/393 |
| 2012/0164928 | A1 * | 6/2012 | Wuest | B66B 11/024 454/68 |
| 2018/0002139 | A1 * | 1/2018 | Stepp | B66B 11/0226 |
| 2019/0256323 | A1 * | 8/2019 | Schuler | B66B 11/0226 |

FOREIGN PATENT DOCUMENTS

| | | | | |
|---|---|---|---|---|
| EP | 0985628 | A2 | 3/2000 | |
| EP | 1500623 | A1 | 1/2005 | |
| EP | 0985628 | B1 | 4/2008 | |
| EP | 1925581 | A1 | 5/2008 | |
| EP | 3315445 | A1 * | 5/2018 | B66B 5/0031 |
| JP | 2014001073 | A | 1/2014 | |
| JP | 2015196572 | A | 11/2015 | |
| JP | 5878882 | B2 | 3/2016 | |
| KR | 101114777 | B1 | 2/2012 | |

* cited by examiner

ELEVATOR CAR

FIELD

The invention relates to an elevator car having a pivotable balustrade that is attached to the roof and can be pivoted, at least in portions, between a folded-down position and an erected position.

BACKGROUND

Elevator systems for conveying people and goods contain elevator cars that are movable up and down, in the vertical direction, in an elevator shaft. The cars can be moved by a drive unit using suspension means, for example in the form of suspension cables or suspension belts.

For particular situations, it may be necessary for a person to access a roof of the elevator car in order to carry out work (e.g. maintenance work, inspection) therefrom. It is necessary, for this purpose, for people to be able to safely spend time on the elevator car roof. If, for example, the width of a gap between the car and an adjacent shaft wall is too large, balustrades have to be installed on the car roof in order protect against falls. Balustrades of this kind on elevator car roofs have per se long been known and have been in common use.

Furthermore, most countries have regulations which specify when a balustrade is to be provided and how it should be designed in principle. Regulations of this kind are specified for example in the European Standard EN81-21.

For example, it may be specified that a balustrade is to be provided on the roof of the elevator car, which balustrade protrudes upwards sufficiently far apart from the roof of the elevator car in order to prevent a person from moving beyond an edge of the roof. According to EN81-21, a balustrade of this kind should protrude upwards, beyond the roof, by at least 70 cm or at least 110 cm, depending on the gap width.

In elevator systems, it may be desirable to keep the elevator shaft as short as possible. The desire for lower heights of head may be opposed by the required minimum height of the balustrade. In the case of elevators without a machine room, in which the drive is arranged in the shaft, it may be that the drive overlaps with the elevator car in plan view, with the result that conventional balustrades are not suitable for these cases. For applications of this kind, pivotable balustrades are proposed which can be pivoted about an axis of rotation, between a folded-down position and an erected position. Pivotable balustrades of this kind, which are also commonly referred to by experts as "foldable balustrades," are known for example from EP 1 925 581 A1.

EP 1 925 581 A1 discloses a pivotable balustrade in which the axle forming the axis of rotation for the pivot movement is mounted in a vertical slot so as to be displaceable to a limited extent. In order to be erected, the balustrade has to be pivoted and simultaneously slightly raised. In order to secure the erected position, a recess, open at the top, is provided on a fastening element on the roof, in which recess a peg, attached to the balustrade, can be inserted by means of sinking. A disadvantage of said balustrade is that the handling is relatively difficult and certain technical skill is required in order to erect and fold back the balustrade.

SUMMARY

An object of the present invention is therefore that of overcoming the disadvantages of the prior art and in particular to provide an elevator car comprising an improved balustrade that is pivotable. If the balustrade is in a folded-down position, it should be able to be easily erected and reliably secured in the erected position.

This object is achieved by an elevator car having a pivotable balustrade that is attached to a roof of the elevator car. In this case, the pivotable balustrade is designed such that it can be pivoted, at least in portions, about a preferably fixed axis of rotation, between a folded-down position in which the balustrade may be oriented substantially horizontally, at least in portions, and an erected position in which the balustrade is oriented substantially vertically.

Since the balustrade comprises a locking mechanism for securing the erected position, by means of which locking mechanism the balustrade can be locked by a latching connection in the event of a pivot movement for establishing the erected position, advantageous handling of the balustrade can be ensured. The balustrade can be easily erected and secured. The locking mechanism is designed such that the balustrade can be automatically fixed in the erected position, by means of the latching connection, during the pivot movement for erecting the balustrade.

In a first embodiment, the balustrade may consist of a lower part which is fixed with respect to the elevator car, and an upper part that is movable about the axis of rotation. A two-part balustrade of this kind is advantageous in particular in terms of health and safety. Compared with balustrades in which the axes of rotation are located in the region of a base of the car roof or a car upper face, with the result that people on the roof are not protected from falling when the balustrade is in the folded-down position, the present balustrade provides some amount of protection even in the folded-down position. This is because the lower part of the balustrade, which, as before, protrudes upwards, has the effect of creating a separation and can protect a falling person from falling into the shaft.

Particularly preferably, the movable part of the balustrade is oriented substantially horizontally in the folded-down position. A stop may be arranged on the stationary part of the balustrade, on which stop the movable part rests in the folded-down position. The stop may for example be an angle piece that is fastened to a post of the stationary part, or a horizontal bent portion.

The mentioned balustrade comprising the lower, stationary part and the upper, movable part may be arranged on the elevator car, on at least one face of the roof. Depending on the embodiment of the shaft, further balustrades may also be provided on the other faces of the car roof. For example, it would be possible to provide a conventional fixed balustrade on an opposite face of the roof for example, in addition to the mentioned two-part balustrade, which conventional balustrade has a lower balustrade height. Said second balustrade could for example be of the same height as the lower stationary part of the first balustrade.

The lower stationary part of the balustrade may be a central, horizontal strut, and the upper movable part may be a handrail. Furthermore, a baseboard may be provided in the region of the upper face of the roof.

The locking mechanism may comprise a latching element that can be brought into engagement with an engagement means in order to secure the erected position. In order to be unlocked from the engagement or from a locking position, the latching element can be moved such that the engagement means is freed, as a result of which the balustrade can be moved back into the folded-down position. The latching element can thus be a latching element that is movable between the mentioned locking position and an unlocking position. The locking mechanism may for example be a latching element that is mounted vertically, so as to be linearly displaceable to a limited extent, or mounted in another manner, under a preload, in a post part associated with the stationary part of the balustrade.

The locking mechanism may comprise at least one spring for generating a preload for the latching element in the locking position. The latching element is thus preloaded into the locking position by means of the spring. The preload makes it possible to ensure reliable locking.

The balustrade can preferably comprise a two-part post comprising a lower post part that is stationary with respect to the elevator car, and an upper post part that is pivotably fastened to the lower post part. The balustrade generally comprises two posts of this kind. The two posts for the lateral boundary of the balustrade and are used to fasten the handrail and further strips such as the central strut, which is located approximately half-way up. The locking mechanism described at the outset may be arranged on a two-part post (optionally even on both posts). In this case, the latching element may be mounted on the lower post part so as to be displaceable to a limited extent. The engagement means with which the latching element can be brought into engagement may be assigned to the upper post part.

At least one vertical slot-like guide for guiding the latching element may be provided in the lower post part. The latching element may for example comprise at least one tongue-like guide portion that can be guided through the guide slot or received therein.

The upper post part may comprise a preferably planar, smooth profile wall, the front edge of which, facing the latching element, forms the engagement means for the engagement with the latching element in the locking position. However, other embodiments of engagement means are of course also conceivable. For example, the engagement means may be formed by a latching hook or a detent cam.

The latching element may comprise a sloped shoulder, along which the engagement means can travel during the erection process or during the pivot movement for establishing the erected position of the balustrade. The latching element may comprise a detent that is arranged on the front end of the sloped shoulder, facing the engagement means.

The actuation element may comprise at least one hand contact surface or foot contact surface that is horizontal in the locking position. This makes it possible to achieve ergonomically favorable actuation of the locking mechanism in order to release the locking position.

The actuation element may be oriented horizontally, at least in the locking position. A sufficiently large force for hand actuation or foot actuation for triggering the unlocking process can be exerted on the horizontally oriented actuation element.

It is advantageous, for the purpose of simple hand actuation of the actuation element or foot actuation of the actuation element, for the actuation element to comprise a lever portion which is substantially horizontal, at least in the locking position, and of which a length of at least 10 cm is self-supporting.

In a preferred embodiment, the actuation element may be formed as a lever that is mounted on a post part so as to be pivotable to a limited extent. The actuation element formed as a lever cooperates with the latching element such that the latching element is displaced, and thus reaches the unlocking position, by means of pivoting the actuation element.

It may be advantageous, for the purpose of simple and cost-effective production, for the latching element and/or the actuation element to be formed as bent parts made of sheet metal.

A further aspect of the invention may be directed to an elevator comprising an elevator shaft and an elevator car that is movable up and down therein, according to the above description.

DESCRIPTION OF THE DRAWINGS

Further individual features and advantages of the invention can be found in the following description of embodiments and in the drawings. In the drawings.

DETAILED DESCRIPTION

Figure 1:
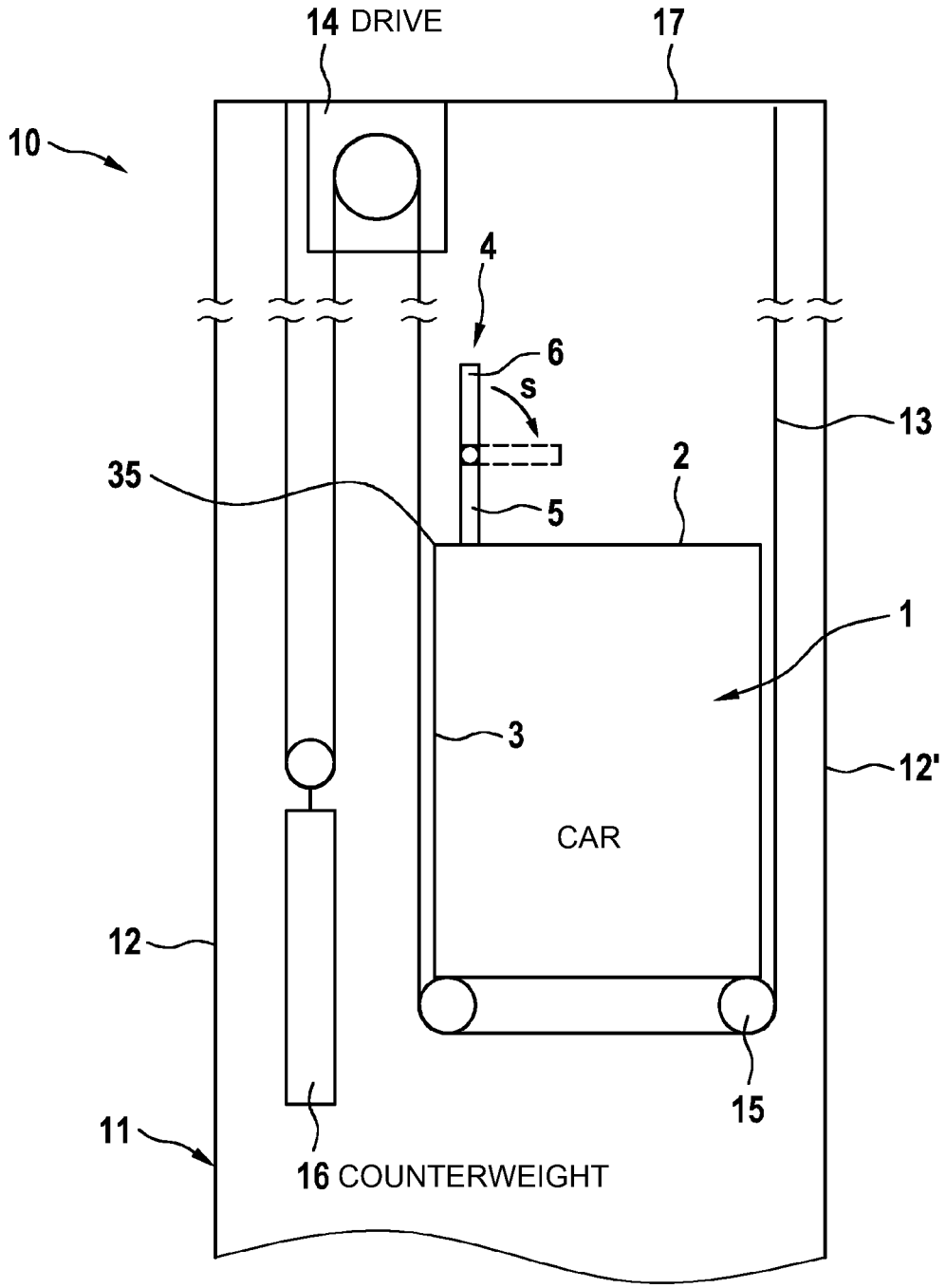
FIG. 1 is a highly simplified schematic side view of an elevator comprising an elevator car according to the invention, on which a pivotable balustrade is arranged.

FIG. 1 shows an elevator system, denoted overall by 10, for a multistory building. The elevator 10 comprises an elevator shaft 11 in which an elevator car 1 for transporting people and goods to individual floors is movable vertically up and down. The movement of the elevator car 1 is achieved by suspension means, denoted by 13, which carries the car 1 in a 2:1 suspension. In this case, the suspension means 13 may be one or more suspension cables or suspension belts.

The suspension means 13 that are movable by a drive 14 carry the car 1 and a counterweight 16. Deflection rollers for forming an undersling are denoted 15, by means of which rollers the car 1 is connected to the suspension means 13. In the present case, the drive 14, which, by way of example, comprises a traction sheave that can be rotated by means of an electric motor, is fastened to a shaft roof 17 in order to form an elevator without a machine room. The drive 14 could, however, of course also be fastened to a shaft wall 12. Alternatively to the schematic embodiment of the elevator shown in FIG. 1, other elevator types and other suspension configurations would also be conceivable. With the exception of a specific balustrade 4, which will be described and shown in detail in the following, elevators 10 comprising other suspension configurations and other elevator types are also conceivable, as alternatives to the elevator variant shown in FIG. 1.

The car 1 comprises a car roof 2 that closes the car 1 at the top. Since there is too large a gap between the shaft wall 12 and a side wall 3 of the car 1, it is necessary, in order to protect against falls, to provide the above-mentioned balustrade 4 on the car roof 2. The balustrade 4 can be transferred from an erected position shown in FIG. 1 into a folded-down position. The corresponding closure movement is indicated by an arrow s. For this purpose, the balustrade 4 is formed in two parts and comprises a lower stationary part 5 and an upper movable part 6. In FIG. 1, dashed lines indicate the upper part 6 in the folded-down position.

In the embodiment according to FIG. 1, only one balustrade 4 is arranged and/or shown on the roof 2 of the car 1. Depending on the car and the design of the shaft, the car 1 could of course also comprise a plurality of balustrades that are each assigned to one face, respectively, of the car 1. Said further balustrades could be designed identically to the balustrade 4, or could be of a conventional rigid construction. For example, owing to the smaller gap between the car 1 and the shaft wall 12' it would be conceivable to provide a lower balustrade on the opposing face, i.e. the face that is facing the shaft wall denoted by 12'. Said lower balustrade could function without movable parts.

Figure 2:
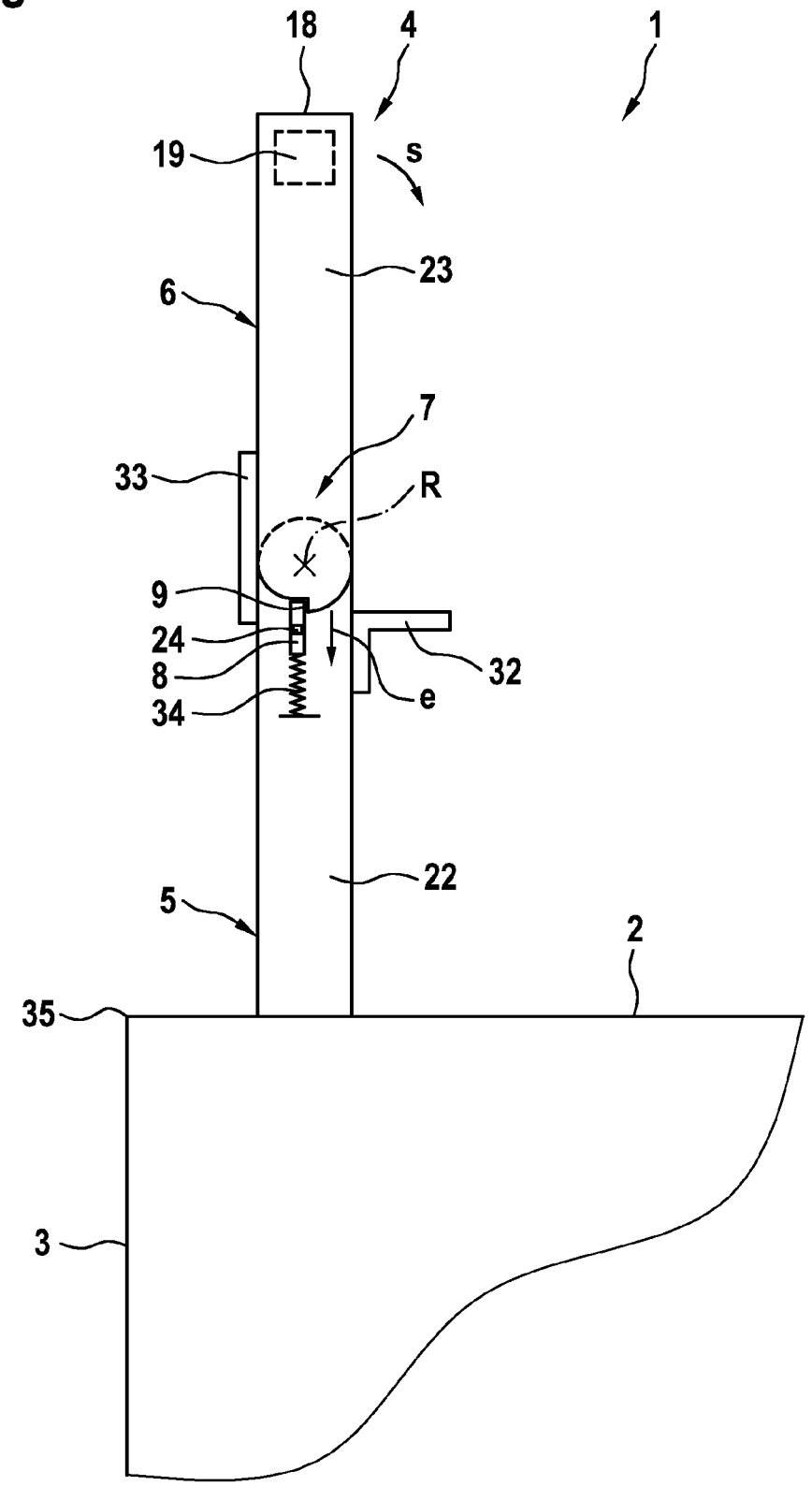
FIG. 2 is an enlarged view of the balustrade from FIG. 1, in an erected position.
Figure 3:
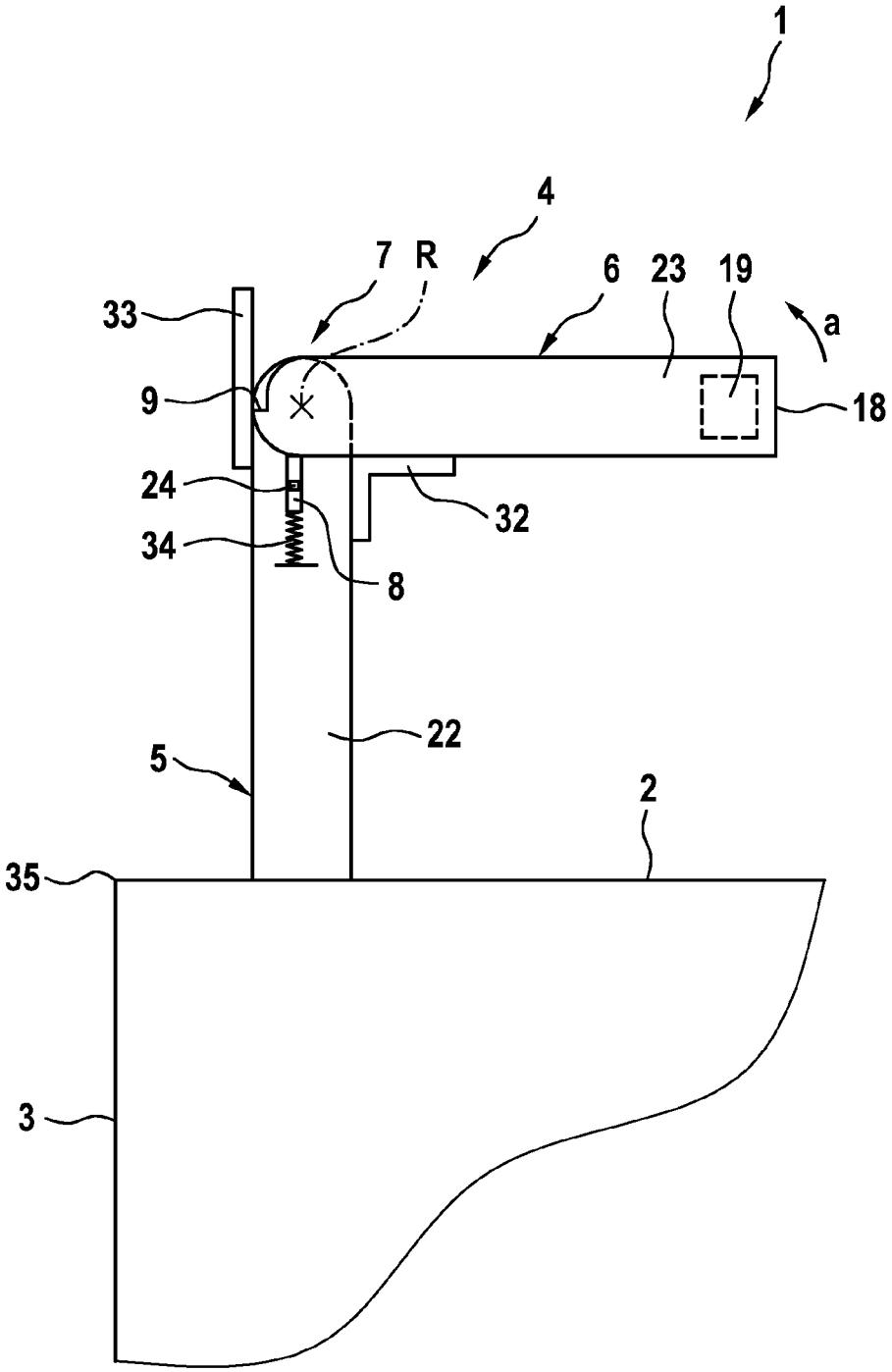
FIG. 3 shows the balustrade in the folded-down position.

FIGS. 2 and 3 show a possible embodiment of a balustrade 4 according to the invention. The lower part 5 of the balustrade 4 is rigidly connected to the car roof 2. In the erected position shown in FIG. 2, the upper part 6 of the balustrade is reliably oriented vertically and secured in position as a result of a locking mechanism 7. The locking mechanism 7 comprises a latching element 8 and an engagement means 9 that cooperates therewith, which latching element and engagement means prevent a pivot movement of the upper part 6 of the balustrade inwards, in the s-direction. A possible pivot movement of the upper part 6 outwards or towards the opposing face is prevented by a vertical stop 33 that is fastened to the lower post part 22.

The upper part can be pivoted about an axis of rotation that is denoted by R and extends horizontally and in parallel with the roof edge 35 of the roof 2. The pivot movement s out of the erected position can be achieved only by releasing the locking mechanism 7. For this purpose, a latching element 8 of the locking mechanism 7 can be moved downwards, in the direction of the arrow e, in order to unlock the locking mechanism 7.

The balustrade 4 comprises two posts 18 that are vertical at least in the erected position and on which horizontal strips, for example the handrail denoted by 19, are attached, as required. The posts 18 are each formed in two parts and comprise a lower post part 22 and an upper post part 23 that is fastened to the lower post part so as to be pivotable about the axis of rotation R.

The upper post part 23 comprises a step-like latching receptacle on the lower end thereof. Said latching receptacle forms an engagement means 9 for the engagement of the latching element 8. In this case, in this embodiment the latching element 8 is a detent cam that is assigned to the lower post part 22. The latching element 8 is pushed upwards, by means of a spring 34, into the corresponding latching receptacle of the engagement means 9.

An actuation element 24, which maintenance personnel or another person on the car roof 2 can grasp, is arranged on the latching element 8. The locking of the locking mechanism 7 is released using the actuation element 24, by means of pulling the latching element 8 downwards in the e-direction. After unlocking has taken place, the upper part 6 of the balustrade 4 can be easily pivoted downwards in the s-direction.

FIG. 3 shows the balustrade in the folded-down position. In the folded-down position, the balustrade 4 is oriented horizontally in portions. In this case, the upper post part 23, which extends horizontally in the folded-down position, rests on a stop 32 that is arranged on the lower post part 22.

In order to establish the erected position, the upper part 6 of the balustrade 4 has to be pivoted upwards in the a-direction. When the balustrade is erected in the a-direction, the latching connection results in the balustrade 4 being automatically secured in the erected position (FIG. 2).

Figure 4:
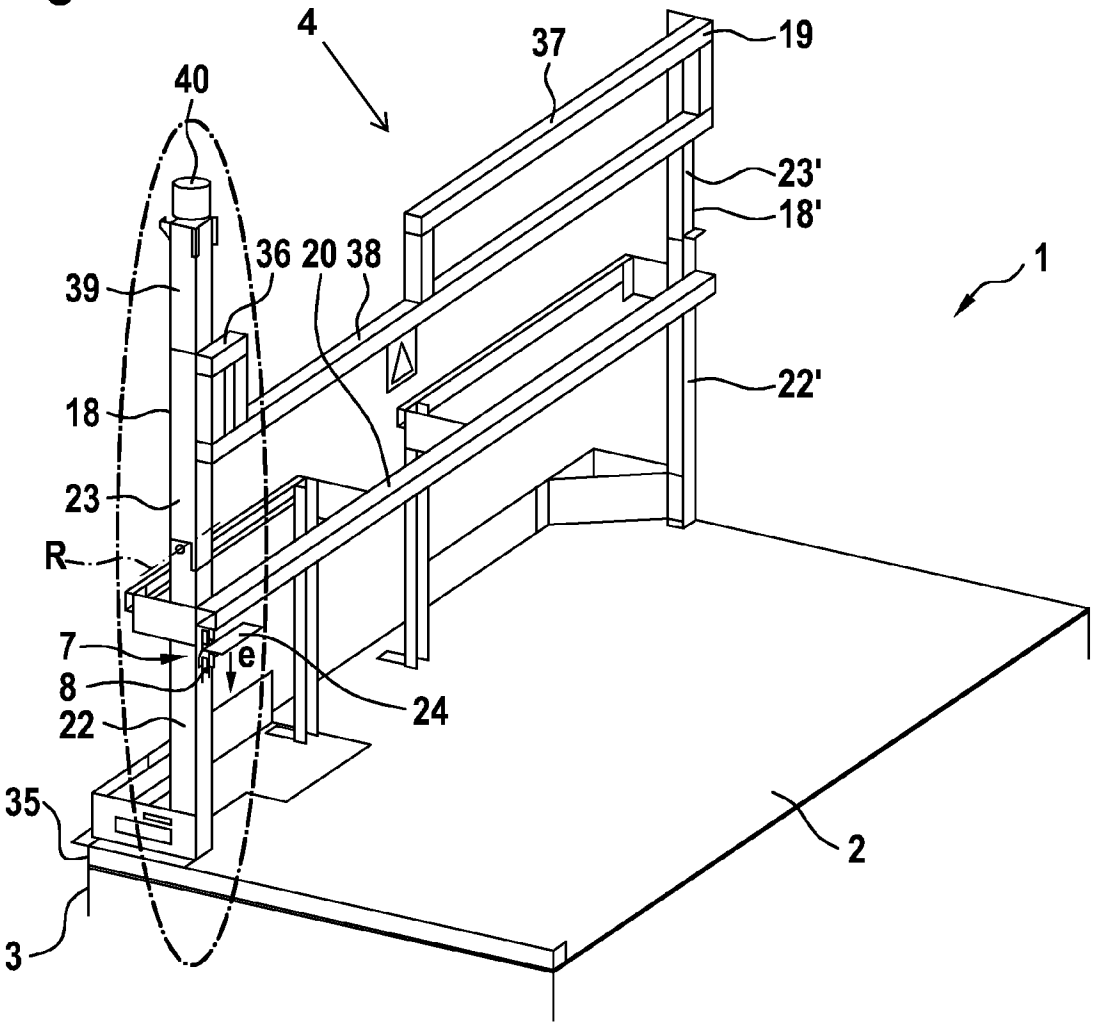
FIG. 4 is a perspective view of a roof of an elevator car, comprising a pivotable balustrade in the erected position, according to a further embodiment.

FIG. 4 shows a pivotable balustrade 4 according to a second embodiment that is attached to a roof 2 of an elevator car 1. The balustrade 4 comprises two posts 18, 18'. A central strut 20 which is arranged approximately half-way up the balustrade is fastened to the lower post parts 22, 22'. The handrail 19 which is assigned to the upper post parts 23, 23' that are pivotable about the axis of rotation R has an interruption in an upper region. The profile parts for the upper handrail portions 36 and 37 are connected, by means of vertical profile parts, to a continuous horizontal profile which forms a lower handrail portion 38 in the region of the interruption.

As can furthermore been seen from FIG. 4, the post 18 comprises an extension. The extension is formed by a profile element 39 that adjoins the upper post part 23. A cushion 40, for example consisting of rubber or another resilient or damping material, is arranged on the free end of the extension 39. The extension 39 comprising the cushion 40 limits possible upwards travel of the car in the upwards direction and, when the balustrade 4 is in the erected position, defines a safety space for people on the car roof.

A horizontal actuation element 24 of the locking mechanism 7 for securing the erected position of the balustrade 4 can be seen in FIG. 4, by means of which actuation element the latching element 8 can be displaced vertically downwards for the purpose of unlocking. Further structural details of the design of the locking mechanism 7 of the second embodiment can be found in FIGS. 5 to 7.

Figure 5:
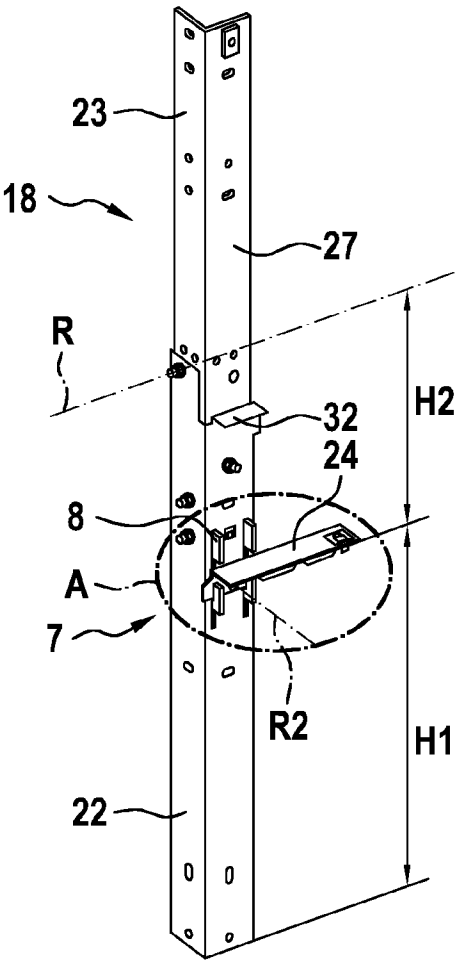
FIG. 5 is a perspective view of a post of the balustrade according to FIG. 4 that is equipped with a locking mechanism for securing the erected position.

FIG. 5 shows the posts 18 that are equipped with the locking mechanism 7. The actuation element 24 for actuating the locking mechanism 7 is mounted on the lower post part 22 so as to be pivotable about an axis of rotation R2. The lever-like actuation element 24 is arranged sufficiently low down that it can be actuated by hand or optionally also foot-actuated by maintenance personnel. The length, denoted L along an upper surface 30 in FIG. 6, by which the lever-like actuation element 24 protrudes, is ideally at least 10 cm. The distance H2, below which the actuation element 24 is arranged, with respect to the axis of rotation R, in order to pivot the balustrade, is therefore at least 10 cm.

In particular when foot-actuation is intended, the distance (H1) between the actuation element 24 and the roof base or the upper face of the car should be small. The actuation element 24 then provides an advantageous foot pedal. In this case, the height H1 should be 30 cm or less.

In the embodiment according to FIG. 5, the stop 32 for limiting the downwards pivot movement for the horizontal folded-down position is achieved by means of a bent portion. Said bent portion is integrally connected to the lower post part 22 that is formed of a metal sheet.

Figure 6:
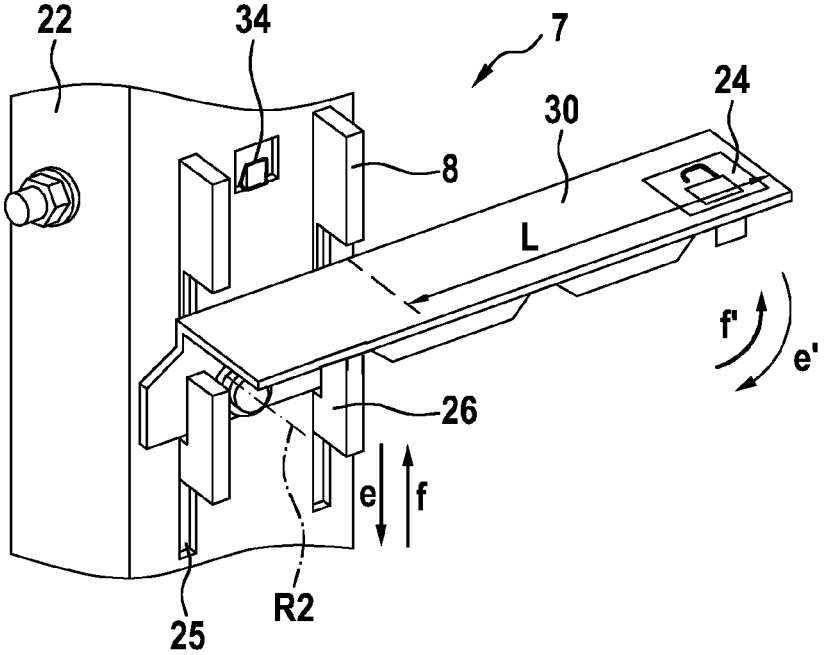
FIG. 6 is a detailed perspective view of the locking mechanism (detail A of FIG. 5)

The enlarged detail view according to FIG. 6 shows that, in order to displaceably mount the latching element 8 in the lower post part 22, two tongue-like guide portions 26 are provided in each case, which guide portions are received in vertical slots 25. The two guide slots 25 allow for precise guidance of the latching element 8. The actuation element 24 is in direct contact with the lower guide portions 26 of the latching element 8. If the actuation element 24 is pivoted downwards in the e'-direction, a translational movement of the latching element 8 downwards results. Said movement of the latching element 8 is indicated by the arrow e.

The spring 34 creates a preload of the latching element 8 into the erected position. The spring 34 results in a restoring force that acts in the arrow direction f, as a result of which automatic latching takes place when the balustrade is erected. Pivoting the actuation element 24 back in the f'-direction also takes place under spring action.

Figure 7:
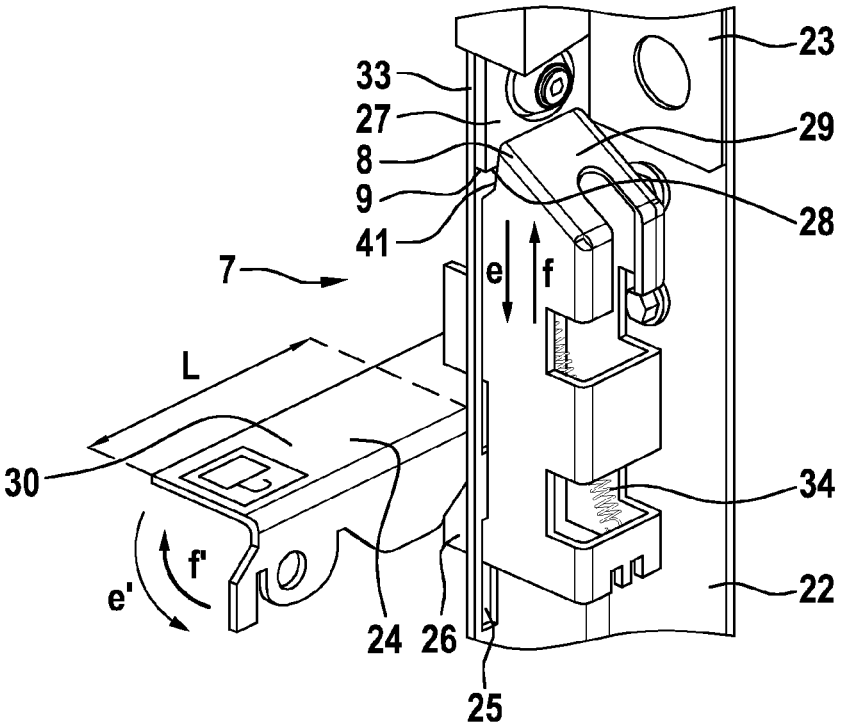
FIG. 7 shows the locking mechanism from FIG. 6, but in a view from the rear.

FIG. 7 clearly shows how the upper post part 23 is fixed in position in the locking position of the latching element 8. In the present case, the upper post part 23 is formed of an L-shaped angle section, the profile wall of the angle section that is denoted 27 being enclosed, in the region of the lower profile edge 28, in a sandwich-like manner between an upper sloped end 29 of the latching element 8 and a wall of the lower post part 22 that forms a stop 33. A recess 41, which is adjusted to the profile thickness of the profile wall 27, is provided in the latching element for the purpose of receiving the profile wall 27, forming an engagement means, in this sandwich-like manner. The wall, facing the latching element 8, of the profile that is L-shaped at least in portions and is intended for forming the lower post part 22, forms the vertical stop 33.

FIG. 7 also shows that the spring 34, which, in the present case, by way of example, is formed by a helical compression spring, is arranged diagonally in the latching element. In this way, the spring 34 reliably retains the latching element 8 in the lower post part 22.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator car having a pivotable balustrade attached to a roof of the elevator car, which balustrade can be pivoted, at least in portions, between a folded-down position and an erected position, the balustrade comprising:

a lower stationary part;

an upper movable part; and a locking mechanism for securing the balustrade in the erected position in which the balustrade is automatically locked by a latching connection between the lower stationary part and the upper movable part in response to a pivot movement of the upper movable part to the erected position, where a latching element of the locking mechanism is mounted on the lower stationary part so as to be vertically displaceable to a limited extent, and an engagement means of the locking mechanism is mounted on the upper movable part so as to automatically engage the latching element when the upper movable part is pivoted to the erected position.

2. The elevator car according to claim 1 wherein the lower stationary part and the upper movable part are connected at an axis of rotation.

3. The elevator car according to claim 2 wherein the upper movable part of the balustrade is oriented horizontally in the folded-down position.

4. The elevator car according to claim 2 wherein the balustrade includes a two-part post having a lower post part and an upper post part, the upper post part being pivotably fastened to the lower post part, the lower stationary part including the lower post part and the upper movable part including the upper post part, the locking mechanism being arranged on the two-part post, the latching element of the locking mechanism being mounted on the lower post part, and the engagement means of the locking mechanism being on the upper post part.

5. The elevator car according to claim 4 wherein at least one vertical guide for guiding the latching element is provided in the lower post part.

6. The elevator car according to claim 4 wherein the upper post part has a profile wall with a lower edge forming the engagement means for the engagement with the latching element when the balustrade is locked.

7. The elevator car according to claim 4 wherein the latching element has a sloped end along which the engagement means travels during the pivot movement for establishing the erected position of the balustrade.

8. The elevator car according to claim 1 wherein the locking mechanism includes a latching element adapted to be brought into engagement with an engagement means to secure the balustrade in the erected position.

9. The elevator car according to claim 8 wherein the locking mechanism includes a spring for generating a preload on the latching element in the erected position.

10. The elevator car according to claim 1 wherein the locking mechanism includes an actuation element, formed as a foot pedal or a lever, for unlocking the locked balustrade.

11. The elevator car according to claim 10 wherein, for the pivot movement of the upper movable part, the actuation element is arranged at a predetermined spacing of between 10 cm and 30 cm below an axis of rotation of the upper movable part.

12. The elevator car according to claim 10 wherein the actuation element is formed as a lever that is mounted on the lower stationary part and is pivotable to a limited extent.

13. The elevator car according to claim 10 wherein the actuation element has a horizontal contact upper surface in the erected position of the balustrade.

14. The elevator car according to claim 13 wherein the contact upper surface of the actuation element has a length of at least 10 cm beyond an axis of rotation of the actuation element.

15. The elevator car according to claim 1 wherein a latching element of the locking mechanism is formed as a bent part from sheet metal.

16. An elevator car having a pivotable balustrade attached to a roof of the elevator car, which balustrade can be pivoted, at least in portions, between a folded-down position and an erected position, the balustrade comprising:

a lower stationary part;

an upper movable part;

a locking mechanism for securing the balustrade in the erected position in which the balustrade is locked by a latching connection between the lower stationary part and the upper movable part in response to a pivot movement of the upper movable part to establish the erected position;

wherein the lower stationary part and the upper movable part are connected at an axis of rotation;

wherein the balustrade includes a two-part post having a lower post part and an upper post part, the upper post part being pivotably fastened to the lower post part, the lower stationary part including the lower post part and the upper movable part including the upper post part, the locking mechanism being arranged on the two-part post, a latching element of the locking mechanism being mounted vertically on the lower post part so as to be displaceable to a limited extent, and an engagement means of the locking mechanism being on the upper post part; and wherein the latching element has a sloped end along which the engagement means travels during the pivot movement for establishing the erected position of the balustrade.

17. An elevator car having a pivotable balustrade attached to a roof of the elevator car, which balustrade can be pivoted, at least in portions, between a folded-down position and an erected position, the balustrade comprising:

a lower stationary part;

an upper movable part connected to the lower stationary part at an axis of rotation;

a locking mechanism for securing the balustrade in the erected position in which the balustrade is automatically locked by a latching connection between the lower stationary part and the upper movable part in response to a pivot movement of the upper movable part to the erected position, wherein the upper movable part of the balustrade is oriented horizontally in the folded-down position; and a stop affixed on the lower stationary part adjacent the axis of rotation which prevents rotation of the upper movable part beyond a horizontal orientation in the folded-down position.

18. An elevator car having a pivotable balustrade attached to a roof of the elevator car, which balustrade can be pivoted, at least in portions, between a folded-down position and an erected position, the balustrade comprising:

a lower stationary part;

an upper movable part connected to the lower stationary part at an axis of rotation; and a locking mechanism for securing the balustrade in the erected position in which the balustrade is automatically locked by a latching connection between the lower stationary part and the upper movable part in response to a pivot movement of the upper movable part to the erected position, wherein the locking mechanism includes an actuation element, formed as a foot pedal or a lever pivotally mounted on the lower stationary part, for unlocking the locked balustrade, and where the actuation element is mounted at a spacing of between 10 cm and 30 cm above the roof of the elevator car and between 10 cm and 30 cm below the axis of rotation of the upper movable part.

* * * * *